United States Patent [19]

Zangenberg

[11] 4,436,489

[45] Mar. 13, 1984

[54] CONTROL DEVICE FOR A LIQUID PUMP WITH ADJUSTABLE PUMPING VOLUME

[75] Inventor: Jan Zangenberg, Nordborg, Denmark

[73] Assignee: Danfoss A/S, Nordborg, Denmark

[21] Appl. No.: 359,756

[22] Filed: Mar. 19, 1982

[30] Foreign Application Priority Data

Oct. 29, 1981 [DE] Fed. Rep. of Germany ..... 3112561

[51] Int. Cl.[3] ..... F04B 49/00

[52] U.S. Cl. ..... 417/218; 60/443; 60/452

[58] Field of Search ..... 417/218-222; 60/445, 452, 443

[56] References Cited

U.S. PATENT DOCUMENTS 3,554,671 1/1971 Schlinke ..... 417/222

FOREIGN PATENT DOCUMENTS 2047977 4/1972 Fed. Rep. of Germany ..... 417/222

*Primary Examiner*—Edward K. Look

*Attorney, Agent, or Firm*—Wayne B. Easton

[57] ABSTRACT

The invention relates to a control unit for an adjustable volume pump of the type having external controls for varying the volume output thereof. A pump for driving a hydraulic motor has the output pressure thereof increase as the motor load increases. The control unit hereof is responsive to the output pressure of the pump and regulates the pump controls to maintain a substantially constant volume through output for the pump despite varying load conditions on the hydraulic motor driven by the pump.

3 Claims, 2 Drawing Figures

CONTROL DEVICE FOR A LIQUID PUMP WITH ADJUSTABLE PUMPING VOLUME

The invention relates to a control device for a liquid pump with adjustable pumping volume, comprising a setting element in the form of a stepped piston of which the smaller pressure area faces a pressure chamber at pump outlet pressure and the larger area faces a pressure chamber at control pressure, and a control valve which determines the control pressure, is fed by the pump outlet and is connected to the tank and the effective position of which depends on the relative positions of a control value generator and a return element connected to the setting element.

In a known control device of this kind (U.S. Pat. No. 3,213,617), the control valve is closed in the neutral position. When the control pressure is too low, the connection to the pump outlet is established and when the control pressure is too high the connection to the tank is established. With such a control device, a defined position to the compression elements of the pump can be set with the aid of the control value generator. However, because of the unavoidable leakage losses, the pumping volume of the pump decreases with increasing pressure at the pump outlet. If, for example, the pump is to feed a motor, its driving or rotary speed decreases with increasing load. This disadvantage is aggravated by the fact that at higher pressure higher leakage losses also arise in the motor or some other consumer.

The invention is therefore based on the problem of providing a control device of the aforementioned kind which ensures that the set pumping volume does not drop with increasing pump outlet pressure but remains substantially constant or even increases slightly.

This problem is solved according to the invention in that a throughflow regulator provided between the pump outlet and control valve keeps the throughflow substantially constant independently of the output pressure, and that the control valve is a throttle valve which is permanently in series with the throughflow regulator and of which the pressure drop determines the control pressure.

In this construction, the pumping volume of the pump is increased with an increase in the outlet pressure as a result of a higher load. Since a substantially constant throughflow is provided by way of the throttle of the control valve, the throttling resistance in the control valve must change with increasing outlet pressure to achieve a new position of equilibrium for the stepped piston. With a stationary control value generator, this is possible only if the stepped piston is displaced in the sense of more intensive pumping by the pump. By means of this more intensive pumping, the leakage losses within the pump and possibly also in the consumer can be compensated to a considerable extent.

In a preferred embodiment, the throughflow regulator comprises a hollow piston which is displaceable in a bore subjected to a spring, has an end wall with a fixed throttle and, with a peripheral edge, controls a throttle aperture in the wall of the bore. Such a throughflow regulator results in a particularly simple construction.

It is also recommended that the follow-up element be formed by a bore in the stepped piston with a valve aperture in the wall of the bore, and that the control value generator should engage in this bore as a piston and comprise an annular groove which co-operates with the valve aperture and is connected by a passage to the pressure chamber at control pressure. This results in a compact constructional unit with short passages.

A preferred example of the invention will now be described in more detail with reference to the drawing, wherein.

Figure 1:
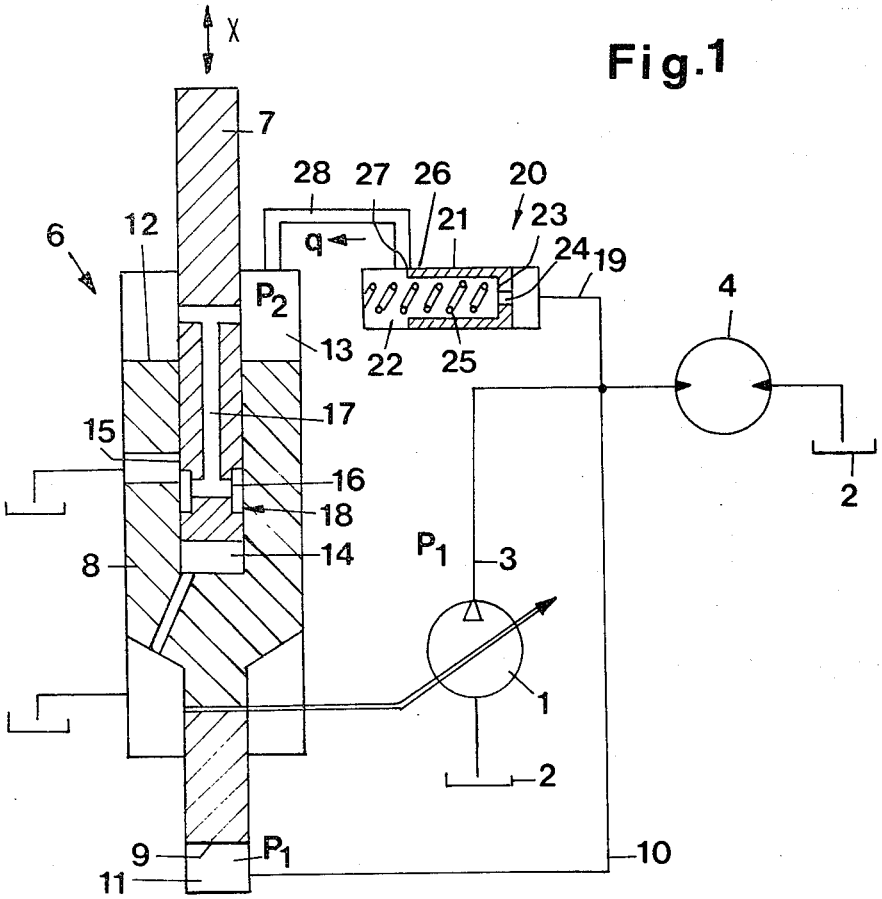
FIG. 1 is a block diagram of a control device according to the invention.

FIG. 1 shows a circuit in which a regulatable pump 1 pumps pressure fluid out of a tank 2, through a pump outlet 3 to a motor 4. By means of a control device 6 which comprises a control value generator 7 in the form of a piston, the rotary speed of this motor 4 can be set. It is assumed that this motor can be subjected to widely different loads, whereby the outlet pressure $P_1$ of the pump will also change.

As a setting element 8, the control device comprises a stepped piston of which the smaller pressure face 9 faces a pressure chamber 11 connected by a conduit 10 to the pump outlet 3 and the larger pressure face 12 faces a pressure chamber 13 which is at control pressure $P_2$. The stepped piston has a bore 14 with a valve aperture 15 as follow-up element. The piston 7 of the control value generator comprises an annular groove 16 connected to the control pressure chamber 13 by a passage 17. The valve aperture 15 and annular groove 16 together form a control valve 18.

In a conduit 19 branching off from the pump outlet 3 there is a throughflow regulator 20 comprising a hollow piston 21 in a bore 22. In an end face 23, the hollow piston carries a throttle aperture 24 and is biassed by a spring 25. With its rear edge 26 it controls a throttle aperture 27 in the bore 22. A conduit 28 leads from the throttle aperture to the control pressure chamber 13.

The stepped piston 8 assumes a position of equilibrium when $$P_1 \times A_9 = P_2 \times A_{12} \quad (1)$$

wherein $A_9$ is the size of the pressure face 9 and $A_{12}$ is the size of the pressure face 12. The control pressure $P_2$ is therefore proportional to the outlet pressure $P_1$ of the pump.

The throughflow regulator 20 allows a constant throughflow q into the control pressure chamber 13 independently of the outlet pressure $P_1$ of the pump. This throughflow leaves through the valve aperture 15 of which the free cross-sectional area is designated $A_{15}$. The following formula then applies $$A_{15} = \frac{q}{K} \times \frac{1}{\sqrt{P_2}} \quad (2)$$

Since the constant K and the amount of throughflow q are constant, the opening area $A_{15}$ is inversely proportional to the square root of the control pressure $P_2$.

It is assumed that a particular pumping quantity for the pump 1 and thus a particular rotary speed of the motor 4 has been set with the aid of the control valve generator 7. If, as a result of increased load on the motor 4, there is an increase in the outlet pressure $P_1$, the control pressure $P_2$ increases proportionally in accordance with equation (1). According to equation (2), $A_{15}$ is thereby reduced, which occurs by the step piston 8 being displaced somewhat upwardly. This displacement brings about an adjustment of the pump 1 in that it is brought to a condition of greater compression. This compensates the leakage losses occurring at higher pressures.

Figure 2:
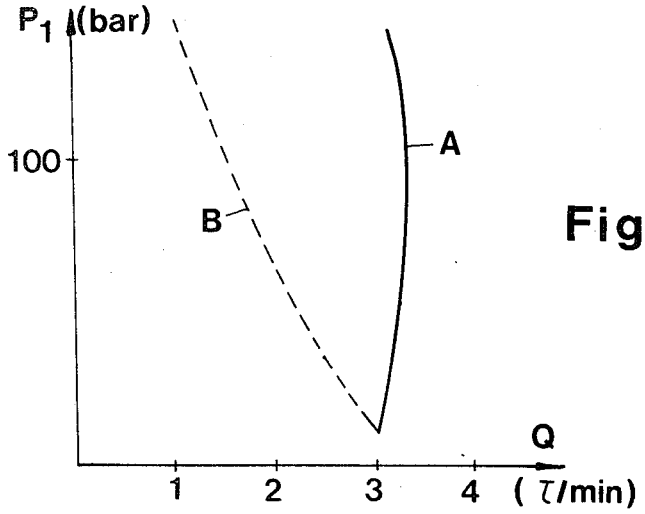
FIG. 2 is a graph of the pumping volume in relation to the outlet pressure of the pump.

FIG. 2 shows a curve A applicable to the control device according to the invention. It will be seen that, with increasing pressure, the pumped volume Q at first increases slightly and then drops off slightly. In the known case, without this compensation the pumped volume drops considerably with increasing pressure in accordance with curve B.

FIG. 1 must be regarded only diagrammatically. Generally, a change-over valve is also provided for the motor 4. It is also possible for several consumers to be connected selectively. The control valve 18 may be arranged separate from the setting element 8.

I claim:

1. A control unit for a pump of the type having adjustable volume control means, comprising, a tank port, a motor speed control setting unit having first and second pressure chambers and a moveable valve element having first and second smaller and larger pressure faces as moveable walls of said pressure chambers, means connecting said moveable valve element to said pump adjustable volume control means, a pressure independent constant flow regulator having an outlet connected to said second pressure chamber, first and second pump outlet ports connected respectively to said first pressure chamber and the inlet of said constant flow regulator, said setting unit having speed setting valve means including a valve member having adjustable fixed positions relative to said moveable valve element and providing variable throttle means between said second pressure chamber and said tank port to establish a control pressure in said second pressure chamber.

2. A control unit according to claim 1, characterized in that said constant flow regulator has a spring biased hollow piston displaceable in a bore, said piston having an end wall with a fixed throttle, and throttled outlet means between said piston and said bore.

3. A control unit according to claim 1 or claim 2 characterized by said moveable valve member having a bore for receiving said speed setting valve member as a piston, said throttle means comprising an annular groove in said piston and a valve aperture in the wall of said bore, and said piston having passage means connecting said annular groove with said second pressure chamber.

* * * * *